US006081287A

United States Patent [19]

Noshita et al.

[11] Patent Number: 6,081,287

[45] Date of Patent: Jun. 27, 2000

[54] THERMAL HEAD METHOD OF MANUFACTURING THE SAME

[75] Inventors: Taihei Noshita; Junichi Yoneda, both of Shizuoka; Makoto Kashiwaya, Kanagawa, all of Japan

[73] Assignee: Fuji Photo Film Co., Ltd., Kanagawa, Japan

[21] Appl. No.: 09/064,106

[22] Filed: Apr. 22, 1998

[30] Foreign Application Priority Data

Apr. 22, 1997 [JP] Japan ..... 9-104262
Jul. 16, 1997 [JP] Japan ..... 9-190988

[51] Int. Cl.[7] ..... B41J 2/335
[52] U.S. Cl. ..... 347/203
[58] Field of Search ..... 347/200, 203; 427/122, 249; 428/908.8

[56] References Cited

FOREIGN PATENT DOCUMENTS 61-53955 11/1986 Japan ..... B41J 3/20
4-62866 10/1992 Japan ..... B41J 2/335
5-8418 1/1993 Japan ..... 347/203
7-132628 5/1995 Japan ..... B41J 2/335

*Primary Examiner*—Huan Tran
*Attorney, Agent, or Firm*—Sughrue, Mion, Zinn, Macpeak & Seas, PLLC

[57] ABSTRACT

The improved thermal head of the invention is the one having a protective film of a heater formed on the heater, the protective film comprising a ceramic-based lower protective layer composed of at least one sub-layer and a carbon-based upper protective layer formed on the lower protective layer, wherein a surface of the lower protective layer on which the upper protective layer is to be formed has a surface roughness value Ra of 0.005 to 0.5 μm; or the one in which the depth of a depression step which may be formed on the surface of the lower protective layer due to the thickness of the electrodes used for supplying power to the heater (or heat-generating resistor) was reduced to 0.2 μm or less. Therefore, the thermal head of the invention has a protective film which has significantly reduced corrosion and wear, which is advantageously protected from cracks and peeling-off due to heat and mechanical impact and which allows the thermal head to have a sufficient durability to exhibit high reliability over an extended period of time, thereby ensuring that the thermal recording of high-quality images is consistently performed over an extended period of operation.

7 Claims, 5 Drawing Sheets

THERMAL HEAD METHOD OF MANUFACTURING THE SAME

BACKGROUND OF THE INVENTION

This invention relates to the art of thermal heads for thermal recording which are used in various types of printers, plotters, facsimile, recorders and the like as recording means.

Thermal materials comprising a thermal recording layer on a substrate of a film or the like are commonly used to record images produced in diagnosis by ultrasonic scanning (sonography).

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a glaze, in which heating elements comprising heaters and electrodes, used for heating the thermal recording layer of a thermal material to record an image are arranged in one direction (main scanning direction) and, with the glaze urged at small pressure against the thermal material (thermal recording layer), the two members are moved relative to each other in the auxiliary scanning direction perpendicular to the main scanning direction, and the heaters of the respective pixels in the glaze are heated by energy application in accordance with image data to be recorded which were supplied from an image data supply source such as MRI or CT in order to heat the thermal recording layer of the thermal material, thereby accomplishing image reproduction.

A protective film is formed on the surface of the glaze of the thermal head in order to protect the heaters for heating a thermal material, the associated electrodes and the like. Therefore, it is this protective film that contacts the thermal material during thermal recording and the heaters heat the thermal material through this protective film so as to perform thermal recording.

The protective film is usually made of wear-resistant ceramics; however, during thermal recording, the surface of the protective film is heated and kept in sliding contact with the thermal material, so it will gradually wear and deteriorate upon repeated recording.

If the wear of the protective film progresses, density unevenness will occur on the thermal image or a desired protective strength can not be maintained and, hence, the ability of the film to protect the heaters is impaired to such an extent that the intended image recording is no longer possible (the head has lost its function).

Particularly in the applications such as the aforementioned medical use which require multiple gradation images of high quality, the trend is toward ensuring the desired high image quality by adopting thermal films with highly rigid substrates such as polyester films and also increasing the setting values of recording temperature (energy applied) and of the pressure at which the thermal head is urged against the thermal material. Under these circumstances, as compared with the conventional thermal recording, a greater force and more heat are exerted on the protective film of the thermal head, making wear and corrosion (or wear due to corrosion) more likely to progress.

With a view to preventing the wear of the protective film on the thermal head and improving its durability, a number of techniques to improve the performance of the protective film have been considered. Among others, a carbon-based protective film (hereinafter referred to as a carbon protective layer) is known as a protective film excellent in resistance to wear and corrosion.

Thus, Examined Published Japanese Patent Applications (KOKOKU) No. 61-53955 and No. 4-62866 (the latter being the divisional application of the former) disclose a thermal head excellent in wear resistance and response which is obtained by forming a very thin carbon protective layer having a Vickers hardness of 4500 kg/mm$^2$ or more as the protective film of the thermal head and a method of manufacturing the thermal head, respectively. The carbon protective layer has properties quite similar to those of diamond including a very high hardness and chemical stability, hence the carbon protective layer presents sufficiently excellent properties to prevent wear and corrosion which may be caused by the sliding contact with thermal materials.

The carbon protective layer is excellent in wear resistance, but brittle because of its hardness, that is, low in tenacity. Heat shock and a thermal stress due to heating of heating elements may bring about rather easily cracks or peeling-off.

In order to resolve the problem, Unexamined Published Japanese Patent Application (KOKAI) No. 7-132628 discloses a thermal head which has a dual protective film comprising a lower silicon-based compound layer and an overlying diamond-like carbon layer, whereby the potential wear and breakage of the protective film due to heat shock are significantly reduced to ensure that high-quality images can be recorded over an extended period of time. In this application, the adhesion of the silicon-based compound layer to the diamond-like carbon layer is improved by subjecting the surface of the silicon-based compound layer to a surface treatment such as plasma-assisted CVD in a reducing atmosphere.

However, the adhesion between the two layers is not enough to protect the protective film from cracks or peeling-off which may be caused by a stress due to a difference in coefficient of thermal expansion between the respective layers, a mechanical impact due to a foreign matter entered between the thermal material and the thermal head (glaze) during recording or other factors.

As shown in FIG. 5, the top of a glaze 182 of a thermal head 166 (which is shown to face down in FIG. 5, since the thermal head 166 is pressed downward against a thermal material A) is overlaid with a heater 184 which, in turn, is overlaid with electrodes 186 provided on both sides at a specified distance, whereupon a depression step having a depth corresponding to the thickness of the electrodes 186 (usually about lam) is formed between the electrodes 186 and the heater 184. Therefore, after forming a protective film comprising two protective layers 188 and 190, the depression step remains as the surface geometry of the protective film. Especially, the mechanical impact due to a foreign matter entered between the thermal material and the thermal head (glaze) during recording or the like readily concentrates in the thus formed depression step on the surface of the protective film. Hence, the diamond-like carbon layer 190 will have cracks or peeling-off in the neighborhood of the depression step.

The cracks or peeling-off in the protective layer give rise to wear, corrosion and wear due to corrosion, which results in reduction of the durability of the thermal head. The thermal head is not capable of exhibiting high reliability over an extended period of time.

SUMMARY OF THE INVENTION

The present invention has been accomplished under these circumstances and has as an object providing a thermal head having a carbon-based protective layer which is significantly protected from corrosion and wear as well as cracks and peeling-off due to heat and mechanical impact, and which allows the thermal head to have a sufficient durability to exhibit high reliability over an extended period of time, thereby ensuring that the thermal recording of high-quality images is consistently performed over an extended period of operation.

Another object of the invention is to provide a method of manufacturing the thermal head.

In order to achieve the above objects, a first aspect of the invention provides a thermal head having a protective film of a heater formed on said heater, said protective film comprising a ceramic-based lower protective layer composed of at least one sub-layer and a carbon-based upper protective layer formed on said lower protective layer, wherein a surface of said lower protective layer on which said upper protective layer is to be formed has a surface roughness value Ra of 0.005 to 0.5 $\mu$m.

The invention also provides a method of manufacturing a thermal head having a protective film of a heater which comprises the steps of forming a ceramic-based lower protective layer composed of at least one sub-layer on said heater and forming a carbon-based upper protective layer on said lower protective layer, wherein said lower protective layer is subjected to a surface treatment to adjust the surface roughness value Ra of said surface to 0.005 to 0.5 $\mu$m, before said upper protective layer is formed on said lower protective layer.

Said surface treatment is preferably a method of grinding by means of lapping sheets or a sandblasting treatment.

Said upper protective layer is preferably formed by sputtering treatment or plasma-assisted CVD treatment.

Said carbon-based protective layer is preferably a high-purity carbon protective layer.

Said carbon-based protective layer has preferably a Vickers hardness of at least 2000 kg/mm$^2$.

Said carbon-based protective layer has preferably a thickness of from 1 to 20 $\mu$m.

Said ceramic-based protective layer is preferably a protective layer made of a material selected from the group consisting of silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures of at least two of these materials.

Said lower protective layer has preferably a thickness of from 0.6 to 50 $\mu$m.

Said carbon-based protective layer has preferably a thickness of from 0.1 to 5 $\mu$m.

A second aspect of the invention provides a thermal head having a heat-generating resistor provided on a substrate, electrodes provided on both sides of said heat-generating resistor to supply power to said heat-generating resistor, and a protective film formed on said heat-generating resistor and said electrodes to protect said heat-generating resistor and said electrodes, said protective film comprising a ceramic-based lower protective layer and a carbon-based upper protective layer formed on said lower protective layer, wherein a depression step which may be formed on a surface of said lower protective layer due to the thickness of said electrodes has a depth which was reduced to 0.2 $\mu$m or less.

A surface treatment may be performed on the surface of said lower protective layer to reduce the depth of said depression step to 0.2 $\mu$m or less.

The depression step formed between said heat-generating resistor and said electrodes may have a depth of not more than 0.2 $\mu$m.

DETAILED DESCRIPTION OF THE INVENTION

The thermal head and the method of manufacturing the thermal head according to the invention will now be described in detail with reference to the preferred embodiments shown in the accompanying drawings.

Figure 1:
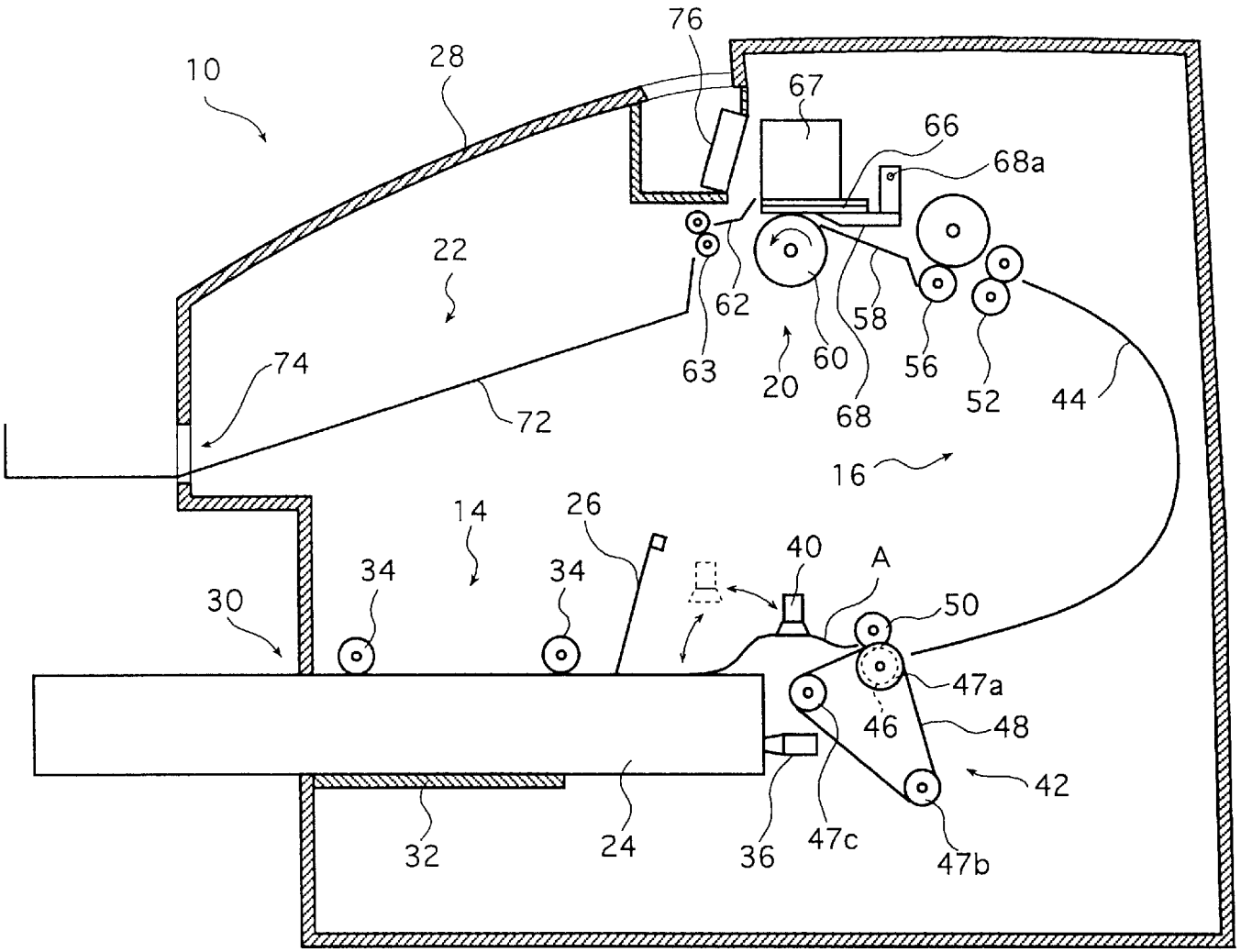
FIG. 1 shows the concept of an exemplary thermal recording apparatus using the thermal head of the invention.

FIG. 1 shows schematically an exemplary thermal recording apparatus using the thermal head of the invention.

The thermal recording apparatus generally indicated by 10 in FIG. 1 and which is hereinafter simply referred to as a "recording apparatus 10" performs thermal recording on thermal materials of a given size, say, B4 (namely, thermal materials in the form of cut sheets, which are hereinafter referred to as "thermal materials A"). The apparatus comprises a loading section 14 where a magazine 24 containing thermal materials A is loaded, a feed/transport section 16, a recording section 20 performing thermal recording on thermal materials A by means of a thermal head 66, and an ejecting section 22.

In the thus constructed recording apparatus 10, a thermal material A is taken out of the magazine 24 and transported to the recording section 20, where the thermal material A against which the thermal head 66 is pressed is transported in the auxiliary scanning direction perpendicular to the main scanning direction in which the glaze extends (normal to the papers of FIGS. 1 and 2) and in the meantime, the individual heating elements are actuated in accordance with image data on the image to be recorded to perform thermal recording on the thermal material A.

The thermal material A comprises a substrate of a resin film such as a transparent polyethylene terephthalate (PET) film, a paper or the like which are overlaid with a thermal recording layer.

Typically, such thermal materials A are stacked in a specified number, say, 100 to form a bundle, which is either wrapped in a bag or bound with a band to provide a package. As shown, the specified number of thermal materials A bundle together with the thermal recording layer side facing down are accommodated in the magazine 24 of the recording apparatus 10, and they are taken out of the magazine 24 one by one to be used for thermal recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The loading section 14 is equipped with a mechanism (not shown) for opening or closing the cover 26 of the magazine.

The feed/transport section 16 has the sheet feeding mechanism using a sucker 40 for grabbing the thermal material A by application of suction, transport means 42, a transport guide 44 and a regulating roller pair 52 located in the outlet of the transport guide 44; thermal materials A are taken one by one out of the magazine 24 in the loading section 14 and transported to the recording section 20.

The transport means 42 comprises a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that pairs with the transport roller 46. The forward end of the thermal material A which has been sheet-fed by means of the sucker 40 is pinched between the transport roller 46 and the nip roller 50 such that the material A is transported.

When a signal for the start of recording is issued, the cover 26 is opened by the OPEN/CLOSE mechanism in the recording apparatus 10. Then, the sheet feeding mechanism using the sucker 40 picks up one sheet of thermal material. A from the magazine 24 and feeds the forward end of the sheet to the transport means 42 (to the nip between rollers 46 and 50). At the point of time when the thermal material A has been pinched between the transport roller 46 and the nip roller 50, the sucker 40 releases the material, and the thus fed thermal material A is supplied by the transport means 42 into the regulating roller pair 52 as it is guided by the transport guide 44.

At the point of time when the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The forward end of the thermal material A first reaches the regulating roller pair 52 as the result of transport by the transport means 42. The regulating roller pair 52 are first at rest. The forward end of the thermal material A stops here and is subjected to positioning.

When the forward end of the thermal material A reaches the regulating roller pair 52, the temperature of the thermal head 66 (the glaze) is checked and if it is at a specified level, the regulating roller pair 52 starts to transport the thermal material A, which is transported to the recording section 20.

The recording section 20 has the thermal head 66, a platen roller 60, a cleaning roller pair 56, a guide 58, a heat sink 67 for cooling the thermal head 66, a cooling fan 76 and a guide 62.

The thermal head 66 is capable of recording on thermal sheets of up to, for example, B4 size at a recording (pixel) density of, say, about 300 dpi. Except for the protective film, the head has a known structure in that it has the glaze in which the heating elements performing thermal recording on the thermal material A are arranged in one direction, that is in the main scanning direction, and the cooling heat sink 67 is fixed to the thermal head 66. The thermal head 66 is supported on a support member 68 that can pivot about a fulcrum 68*a* in the up and down direction.

The glaze of the thermal head 66 will be described in detail later.

It should be noted that the thermal head 66 of the invention is not particularly limited in such aspects as the width (in the main scanning direction), resolution (recording density) and recording contrast; preferably, the head width ranges from 5 cm to 50 cm, the resolution is at least 6 dots/mm (ca. 150 dpi), and the recording contrast consists of at least 256 levels.

Figure 2:
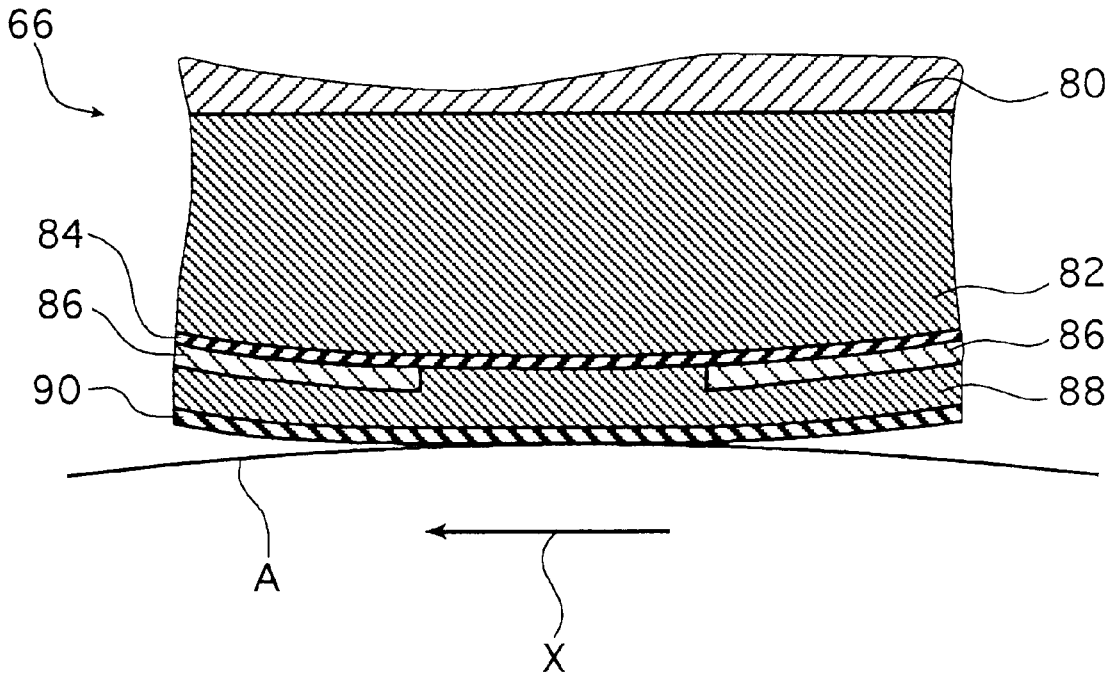
FIG. 2 is a schematic cross sectional view showing the structure of a heating element in the thermal head of the invention.

The platen roller 60 rotates at a specified image recording speed in the direction shown by the arrow in FIG. 1 while holding the thermal material A in a specified position and transports the thermal material A in the auxiliary scanning direction which is perpendicular to the main scanning direction and is shown by the arrow X in FIG. 2.

The cleaning roller pair 56 comprises an adhesive rubber roller made of an elastic material (upper side in the drawing) and a non-adhesive roller. The adhesive rubber roller picks up dirt and other foreign matter that has been deposited on the thermal recording layer of the thermal material A, thereby preventing the dirt from being deposited on the glaze or otherwise adversely affecting the image recording operation.

Before the thermal material A is transported to the recording section 20, the support member 68 in the illustrated recording apparatus 10 has pivoted to UP position so that the glaze of the thermal head 66 is in the standby position just before coming into contact with the platen roller 60.

When the transport of the thermal material A by the regulating roller pair 52 starts, said material is subsequently pinched by the cleaning roller pair 56 and transported as it is guided by the guide 58. When the forward end of the thermal material A has reached the record START position (i.e., corresponding to the glaze), the support member 68 pivots to DOWN position and the thermal material A becomes pinched between the glaze and the platen roller 60 such that the glaze is pressed onto the recording layer while the thermal material A is transported in the auxiliary scanning direction by means of the platen roller 60 and other parts as it is held in a specified position by the platen roller 60.

During this transport, the respective heating elements on the glaze are actuated imagewise to perform thermal recording on the thermal material A.

After the end of thermal recording, the thermal material A as it is guided by the guide 62 is transported by the platen roller 60 and the transport roller pair 63 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

FIG. 2 is a schematic cross section of the glaze (or heating element) of the thermal head 66. As shown, to form the glaze, the top of a substrate 80 (which is shown to face down in FIG. 2 since the thermal head 66 is pressed downward against the thermal material A) is overlaid with a glaze layer (heat accumulating layer) 82 which, in turn, is overlaid with a heater (heat-generating resistor) 84 which, in turn, is overlaid with electrodes 86 which, in turn, is overlaid with a protective film which protects the heater 84 and optionally the electrodes 86 and other parts.

The illustrated protective film is composed of two layers: a ceramic-based lower protective layer 88 superposed on the heater 84 and the electrodes 86, and a carbon-based upper protective layer, for example, carbon protective layer 90 (preferably diamond-like carbon (DLC) protective layer) which is formed on the lower protective layer 88.

The thermal head 66 of the invention has essentially the same structure as known versions of thermal head except for the protective film. Therefore, the arrangement of other layers and the constituent materials of the respective layers are not limited in any particular way and various known versions may be employed. Specifically, the substrate 80 may be formed of various electrical insulating materials including heat-resistant glass and ceramics such as alumina, silica and magnesia; the glaze layer 82 may be formed of heat-resistant glass, heat resistant resins including polyimide resin and the like; the heater 84 may be formed of heat-generating resistors such as Nichrome (Ni—Cr), tantalum metal and tantalum nitride; and the electrodes 86 may be formed of electrically conductive materials such as aluminum, gold, silver and copper.

Heating elements on the glaze are known to be available usually in two types, one being of a thin-film type which is formed by a "thin-film" process such as vacuum evaporation, chemical vapor deposition (CVD) or sputtering and a photoetching technique, and the other being of a thick-film type which is formed by "thick-film" process comprising the steps of printing (e.g., screen printing) and firing and an etching technique. The thermal head 66 for use in the invention may be formed by either method.

As described above, the illustrated thermal head 66 comprises a protective film composed of the two layers: the carbon protective layer 90 and the lower protective layer 88. More preferred results can be obtained by the lower protective layer in various aspects including resistance to wear, resistance to corrosion and resistance to corrosion wear. A thermal head having a higher durability and a long service life can be thus realized.

The material of the lower protective layer 88 to be formed on the thermal head 66 of the invention is not limited in any particular way and the lower protective layer 88 may be formed of a variety of ceramic-based materials as long as they have sufficient heat resistance, corrosion resistance and wear resistance to serve as the protective film of the thermal head.

Specific materials include silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures thereof. Among others, silicon nitride, silicon carbide, SIALON are advantageously utilized in various aspects such as easy film deposition, reasonability in manufacturing including manufacturing cost, balance between mechanical wear and chemical wear. Additives such as metals may be incorporated in small amounts into the lower protective layer to adjust physical properties thereof.

Methods of forming the lower protective layer 88 are not limited in any particular way and known methods of forming ceramic films (layers) may be employed by applying the aforementioned thick-film and thin-film processes and the like.

The thickness of the lower protective layer 88 is not limited to any particular value but it ranges preferably from about 0.6 μm to about 20 μm, more preferably from about 2 μm to about 15 μm. If the thickness of the lower protective layer 88 is within the stated ranges, preferred results are obtained in various aspects such as the balance between wear resistance and heat conductivity (that is, recording sensitivity).

The lower protective layer 88 may comprise multiple sub-layers. In this case, multiple sub-layers may be formed of different materials or multiple sub-layers different in density may be formed of one material. Alternatively, the two methods may be combined to obtain sub-layers.

The thermal head 66 of the invention has a dual protective film comprising the lower protective layer 88 and the carbon-based protective layer 90 deposited thereon. Thus, excellent wear resistance and corrosion resistance are imparted to the carbon protective layer 90, which can be protected to some extent from cracks and peeling-off due to the heat shock and thermal stress as described above.

However, when forming the carbon protective layer 90 after subjecting the underlying silicon nitride film to a surface treatment as conventionally performed in the film deposition process including radio-frequency (RF) etching or without performing any surface treatment (in these cases, the Ra value to be described below is in general about 30 nm), the carbon protective layer 90 does not have a sufficient adhesion to the lower layer (the lower protective layer 88 in the illustrated case) to be protected from cracks and peeling-off which may be caused by a stress due to a difference in coefficient of thermal expansion between the two layers, a mechanical impact due to a foreign matter or other factors.

It has been found that the durability of the thermal head 66 is significantly improved by performing a surface treatment on the silicon nitiride film formed as the lower protective layer 88 until the Ra value to be described below reaches 0.005 to 0.5 μm. The thermal head 66 according to the first aspect of the invention has been thus completed.

In the thermal head 66 fabricated as described above according to the invention, the carbon protective layer 90 can be effectively protected from cracks and peeling-off. The carbon protective layer 90 having very high chemical stability can also protect the ceramic-based lower protective layer 88 from chemical corrosion to thereby prolong the service life of the thermal head. The thermal head 66 of the invention has thus a sufficient durability to exhibit high reliability over an extended period of time, thereby ensuring that the thermal recording of high-quality images is consistently performed over an extended period of operation.

Especially, when recording under high-energy and high-pressure conditions on thermal films using a highly rigid substrate such as a polyester film or the like as in the aforementioned medical use, the thermal head also has a sufficient durability to exhibit high reliability over an extended period of time.

In the method of fabricating the thermal head according to the first aspect of the invention, it is necessary to roughen the surface of the lower protective layer 88 until the Ra value referring to the surface roughness reaches 0.005 to 0.5 μm. The Ra value is preferably in the range of from 0.005 to 0.2 μm, more preferably from 0.005 to 0.05 μm. When the Ra value is less than 0.005 μm, a sufficient adhesion is not obtained between the carbon protective layer 90 and the lower protective layer 88, which may bring about unpreferably cracks or peeling-off in the carbon protective layer 90. On the other hand, when the Ra value is more than 0.5 μm, the glaze of the thermal head does not have sufficiently uniform properties in the respective portions, which prevent unpreferably the thermal head from recording sufficiently uniform high-quality images without density unevenness.

The Ra value as used therein refers to the average roughness in center line. The surface geometry of the lower protective layer 88 was measured two-dimensionally to obtain a roughness curve, from which a roughness portion to be measured and having a length "l" was extracted in the direction of its center line. The value calculated by the following equation (1) was used as the Ra value, based on the roughness curve expressed by y=f(x) in which the center line in the extracted portion is taken on the X-axis, and the direction in the longitudinal magnification on the Y-axis. Alternatively, the surface geometry may be measured tri-dimensionally to obtain a roughness curved surface expressed by z=f(x,y), from which a portion having a surface "s" is extracted and the value calculated by the following equation (2) may be used.

$$Ra = \frac{1}{l}\int_0^l |f(x)|\,dx \tag{1}$$

$$Ra = \frac{1}{s}\int\int |f(x, y)|\,dx\,dy \tag{2}$$

Surface treatment methods of the invention are not limited in any particular way and known various methods may be employed, as far as the above Ra value is obtained. Preferred examples include a sandblasting treatment, a method of grinding by means of lapping sheets and the like, because there is no water permeation in these methods and the surface can be treated without reducing the properties of the glaze.

Methods for sandblasting treatment are not limited in any particular way as far as the above Ra value is obtained by roughening the surface of the lower protective layer 88 with an abrasive, but an induction-type blasting machine is preferably used. Preferred abrasives used in the induction-type blasting machine include but are not limited to glass bead, steel grit and alundum of #60 to #200. The air pressure when spraying with an abrasive is preferably from 5 to 7 kg/cm$^2$.

When using lapping sheets, known lapping sheets may be used to grind the lower protective layer 88 of the thermal head 66 mechanically or by manual operation. In mechanical grinding, lapping sheets are passed under the lower protective layer 88 of the thermal head, while being in contact therewith. The lapping sheet is not limited to any particular type, as far as the above Ra value is obtained. Preferred lapping sheets are of #1000 to #15000.

In the thermal head 66 according to the first aspect of the invention, the surface treatment is thus performed on the lower protective layer 88 before the carbon-based protective layer 90 is formed thereon.

As described above, the thermal head 66 has a depression step having usually a depth of 1 μm between the electrodes and the heater, and after forming the protective layers thereon, the depression step remains as the surface geometry of the protective film. Mechanical impact due to a foreign matter entered between the thermal material and the thermal head (glaze) during recording or the like readily concentrates on the depression step thus formed on the surface of the carbon protective layer 90, which may cause cracks or peeling-off in the neighborhood of the depression step.

In order to overcome the problem, in the thermal head 66 according to the second aspect of the invention, the depth of the depression step which may be formed on the surface of the lower protective layer 88 due to the thickness of the electrodes was reduced to 0.2 μm or less, after which the carbon protective layer 90 was formed thereon.

The depression step on the surface of the carbon protective layer on which especially mechanical impact readily concentrates can be extremely lessened or completely removed by adopting the above structure. Therefore, the mechanical impact applied to the surface of the carbon protective layer 90 is not locally concentrated but dispersed on the entire surface, whereupon the carbon protective layer 90 can be effectively protected from cracks and peeling-off.

As described above, the carbon protective layer 90 having very high chemical stability can also protect the ceramic-based lower protective layer 88 from chemical corrosion to thereby prolong the service life of the thermal head. Therefore, in combination with the improved surface geometry of the carbon protective layer 90, the thermal head 66 of the invention has a sufficient durability to exhibit high reliability over an extended period of time, thereby ensuring that the thermal recording of high-quality images is consistently performed over an extended period of operation.

Especially, when recording under high-energy and high-pressure conditions on thermal films using a highly rigid substrate such as a polyester film or the like as in the aforementioned medical use, the thermal head also has a sufficient durability to exhibit high reliability over an extended period of time.

The depth of the depression step in the lower protective layer 88 is not more than 0.2 μm, preferably not more than 0.1 μm, more preferably not more than 0.05 μm. If the depth is within the defined ranges, the depression step which may be caused on the surface of the carbon protective layer 90 formed can be extremely lessened, so that the mechanical impact is not locally concentrated but dispersed and the protective layer 90 can be thus effectively protected from cracks, peeling-off and other defects.

Specifically, the lower protective layer 88 is subjected to a grinding treatment with lapping sheets in order to reduce the depth of the depression step on the surface of the lower protective layer 88 to 0.2 μm or less.

The lapping sheet is not limited to any particular type and known various lapping sheets can be used, as far as they are suitable for grinding the ceramic-based lower protective layer 88. Preferred specific lapping sheets are of #4000 to #16000. A preferred material of the lapping sheet includes alumina.

The lower protective layer 88 can be subjected to the mechanical or manual grinding treatment with lapping sheets.

In mechanical grinding, for example, lapping sheets are passed under the thermal head mounted on the printer.

In the thermal head 66 of the invention, various pretreatment methods including not only the method in which the depth of the depression step on the surface of the lower protective layer 88 is reduced by the grinding treatment with lapping sheets, but also any method by which the depth of the depression step on the surface of the lower protective layer 88 is consequently reduced to 0.2 μm or less can be used.

Thus, sandblasting treatment may be performed using an induction-type blasting machine.

In addition, the thermal head 66 may have such a structure that the electrodes 86 and the heater 84 are arranged to reduce the initial depth of the depression step on the surface of the lower protective layer 88 to 0.2 μm or less. In this case, the depth of the depression step formed between the electrodes 86 and the heater 84 can be reduced to 0.2 μm or less, by a method in which the thickness of the electrodes 86 are decreased to 0.2 μm or less, or another method in which the heater or the underlying glaze layer 82 on which the electrodes 86 are to be arranged is previously etched to provide a depression step having a depth corresponding to the thickness of the electrodes. In this way, the depth of the depression step on the surface of the lower protective layer 88 formed does not exceed 0.2 μm and the surface is substantially flattened. Alternatively, the ends (corners) of the electrodes may be tapered to lessen the depression step. Methods of adjusting the initial depth of the depression step to 0.2 μm or less are not limited in any particular way and a variety of methods can be used.

In the thermal head 66 according to the second aspect of the invention, the surface treatment is thus performed on the lower protective layer 88 to reduce the depth of the depression step to 0.2 μm or less before the carbon-based protective layer 90 is formed thereon.

In the first and second aspects of the invention, the thermal head 66 uses the carbon protective layer 90, for example the DLC protective layer as the carbon-based protective layer. The carbon-based protective layer of the invention refers to a carbon protective layer containing more than 50 atm % of carbon. The carbon-based protective layer is preferably a carbon protective layer comprising carbon and inevitable impurities, more preferably a high-purity carbon protective layer having extremely reduced or no inevitable impurities, for example the DLC protective layer. The inevitable impurities include residual gases in the vacuum chamber exemplified by oxygen and gases used during the process such as argon (Ar). The content of the gaseous components incorporated into the carbon protective layer is suitably as low as possible, preferably not more than 2 atm %, more preferably not more than 0.5 atm %. According to the invention, the components to be incorporated in addition to carbon to form the carbon-based protective layer include advantageously elements such as hydrogen, nitrogen and fluorine, and semi-metals and metals such as Si, Ti, Zr, Hf, V, Nb, Ta, Er, Mo and W. In the case of hydrogen, nitrogen and fluorine, the content thereof in the carbon-based protective layer is preferably less than 50 atm %, and in the case of the abovementioned semi-metals and metals such as Si, Ti and the like, the content thereof is preferably not more than 20 atm %.

We will now describe the carbon protective layer 90 as a typical example of the carbon-based protective layer, but it is to be understood that the description is also applied to other carbon-based protective layers.

As described above, the carbon protective layer 90 having very high chemical stability can protect the lower protective layer 88 from chemical corrosion to thereby prolong the service life of the thermal head.

The hardness of the carbon protective layer 90 is not limited to any particular value as far as the carbon protective layer 90 has a sufficient hardness to serve as the protective film of the thermal head. Thus, the carbon protective layer 90 having a Vickers hardness of from 3000 kg/mm$^2$ to 5000 kg/mm$^2$ is advantageously illustrated. The hardness may be constant or varied in the thickness direction of the carbon protective layer 90. In the latter case, the hardness variation may be continuous or stepwise.

Methods of forming the carbon protective layer 90 are not limited in any particular way and known thick- and thin-film processes may be employed. Preferred examples include the plasma-assisted CVD using a hydrocarbon gas as a reactive gas to form a hard carbon film and the sputtering of a carbonaceous material (e.g., sintered carbon or glassy carbon) as a target to form a hard carbon film.

The carbon protective layer 90 may be formed with heating on the lower protective layer 88, whereby the heat resistance and hardness of the carbon protective layer 90 and the adhesion to the lower protective layer 88 can be further improved and more excellent durability can be imparted to the carbon protective layer 90 so that the carbon protective layer 90 is protected from cracks and peeling-off which may be caused by a heat shock due to annealing of the heaters and a mechanical impact due to a foreign matter entered between the thermal material and the thermal head during recording, as well as from change in properties and wear-out of the carbon layer due to high power recording.

The heating temperature is preferably in the range of from 200 to 450° C., more preferably from 200 to 300° C. If the temperature is within the defined ranges, the adhesion of the carbon protective layer 90 to the lower protective layer 88 and the durability of the carbon protective layer 90 itself are the most preferred. Preferred methods include but are not limited to a method in which a heater is provided on the upper surface of a substrate holder in a film deposition apparatus such as a sputtering apparatus or a plasma-assisted CVD apparatus and a substrate put on the heater is heated in whole through the surface of the lower protective layer 88, and another method in which the thermal head 66 is energized to generate heat in the thermal head 66 itself to thereby heat the surface of the lower protective layer 88, and other various heating methods can be used.

Figure 3:
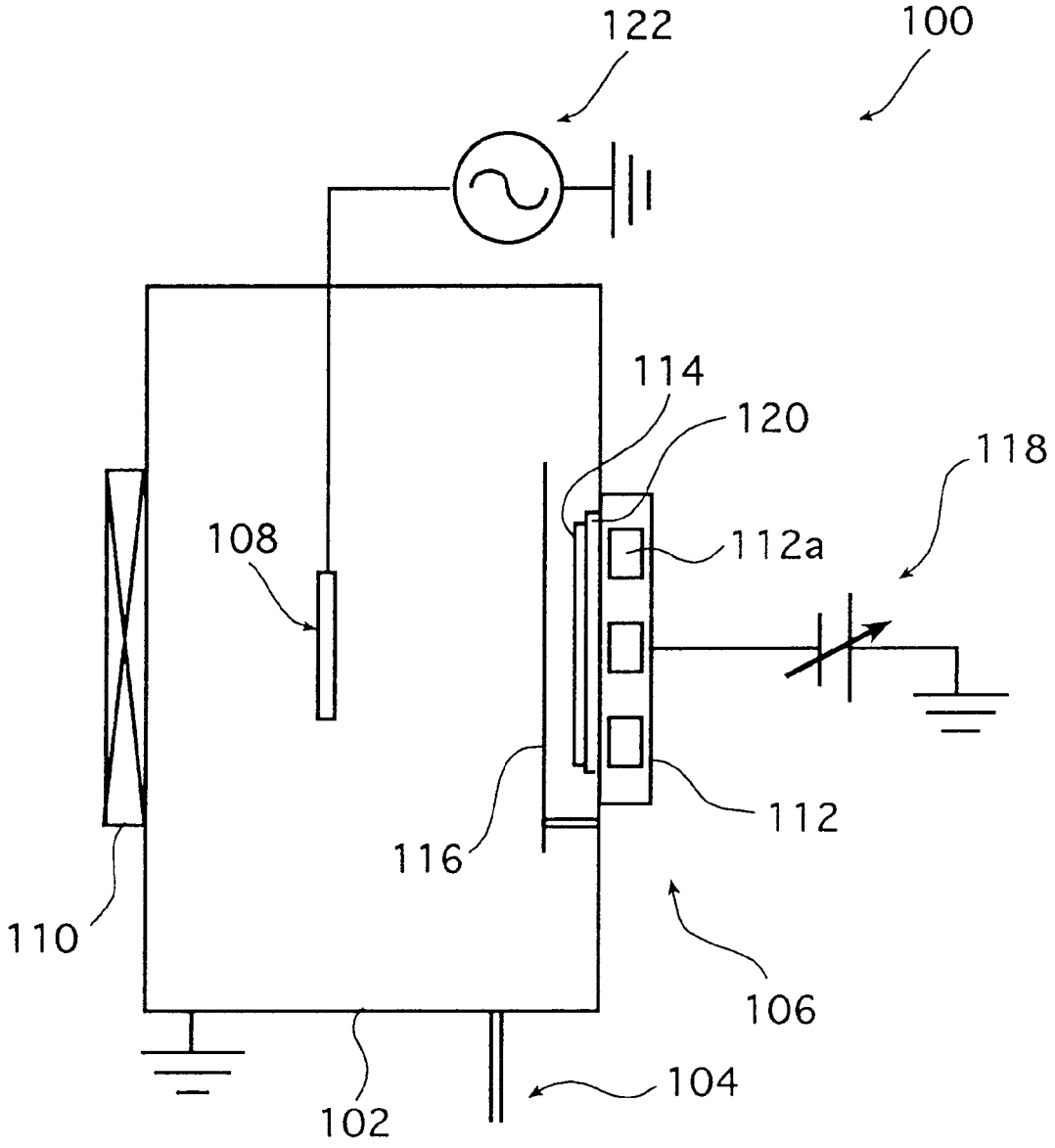
FIG. 3 shows the concept of an exemplary sputtering apparatus for forming a carbon protective layer on the thermal head of the invention.

FIG. 3 shows the concept of a sputtering apparatus to form the carbon protective layer 90. The sputtering apparatus generally indicated by 100 comprises a vacuum chamber 102, a gas introducing section 104, sputter means 106 and a substrate holder 108 as the basic components.

The vacuum chamber 102 is preferably formed of a nonmagnetic material such as SUS 304 in order to keep unperturbed the magnetic field of a cathode 112 to be described below.

Preferably, the vacuum chamber 102 which is used to form the carbon protective layer 90 of the invention presents such a vacuum seal property that an ultimate pressure of $2\times10^{-5}$ Torr or below, preferably $5\times10^{-6}$ Torr or below, is reached by initial pump-down whereas an ultimate pressure between $1\times10^{-4}$ Torr and $1\times10^{-2}$ Torr is reached during film deposition.

Vacuum pump-down means 110 is provided for the vacuum chamber 102 and a preferred example is the combination of a rotary pump, a mechanical booster pump and a turbomolecular pump; pump-down means using a diffusion pump or a cryogenic pump may be suitably used instead of the turbomolecular pump. The performance and number of vacuum pump-down means 110 may be determined as appropriate for various factors including the capacity of the vacuum chamber 102 and the flow rate of a gas used during film deposition. In order to increase the pumping speed, various adjustment designs may be employed, such as bypass pipes that provide for evacuation resistance adjustment and orifice valves which are adjustable in the degree of opening.

The gas introducing section 104 is a site for introducing a plasma generating gas into the vacuum chamber 102 through stainless steel pipes or the like that are vacuum sealed with O-rings or the like at the inlet. The amounts of the gases being introduced are controlled by known means such as a mass flow controller.

The gas introducing section 104 is basically so adapted as to displace the introduced gas to the neighborhood of the plasma-generating region in the vacuum chamber 102. The blowout position is preferably optimized to be such that the profile of the generated plasma will not be adversely affected.

Examples of the plasma generating gas for producing the carbon protective layer 90 are inert gases such as helium, neon, argon, krypton and xenon, among which argon gas is used with particular advantage because of its price and easy availability.

To effect sputtering, a target 114 to be sputtered is placed on the cathode 112, which is rendered at negative potential and a plasma is generated on the surface of the target 114, whereby atoms are struck out of the target 114 and deposit on the surface on the opposed substrate (i.e., the glaze 82 of the thermal head 66) to form the film.

The sputter means 106 comprises essentially the cathode 112, the area where the target 114 is to be placed, a shutter 116 and other components.

In order to generate a plasma on the surface of the target 144, the negative side of a direct current (DC) power supply 118 is connected directly to the cathode 112, which is supplied with a DC voltage of −300 to −1,000 V. The DC power supply 118 has an output of about 1 to 10 kW and a device having the necessary and sufficient output to produce the carbon protective layer 90 may appropriately be selected. The geometry of the cathode 112 may be determined as appropriate for various factors such as the geometry of the substrate on which the carbon protective layer 90 is to be formed. For anti-arc and other purposes, a DC power supply pulse-modulated for 2 to 20 kHz is also applicable with advantage.

Radio-frequency power supplies are also useful to generate plasmas. If an RF power supply is to be used, a radio-frequency voltage is applied to the cathode 112 via a matching box so as to generate a plasma. The matching box performs impedance matching such that the reflected wave of the radio-frequency voltage is no more than 25% of the incident wave. A suitable RF power supply may be selected from those in commercial use which produce outputs at 13.56 MHz having powers in the range of from about 1 kW to about 10 kW which are necessary and sufficient to produce the carbon protective layer 90.

The target 114 may be secured directly to the cathode 112 with In-based solder or by mechanical fixing means but usually a backing plate 120 made of oxygen-free copper, stainless steel or the like is first fixed to the cathode 112 and the target 114 is then attached to the backing plate 120 by the methods just described above. The cathode 112 and the backing plate 120 are adapted to be water-coolable so that the target 114 is indirectly cooled with water.

The target 114 used to form the carbon protective layer 90 is preferably made of sintered carbon, glassy carbon or the like. The geometry of the target. 114 may be determined as appropriate for the geometry of the substrate.

Another method that can advantageously be employed to form the carbon protective layer 90 is magnetron sputtering, in which magnets 112*a* such as permanent magnets or electromagnets are placed within the cathode 112 and a sputtering plasma is confined within a magnetic field formed on the surface of the target 114. Magnetron sputtering is preferred since it achieves high deposition rates.

The shape, position and number of the permanent magnets or electromagnets to be used and the strength of the magnetic field to be generated are determined as appropriate for various factors such as the thickness and its profile of the carbon protective layer 90 to be formed and the geometry of the target 114. Using permanent magnets such as Sm—Co and Nd—Fe—B magnets which are capable of producing intense magnetic fields is preferred for several reasons including the high efficiency of plasma confinement.

The substrate holder 108 fixes the thermal head 66 in position so that the glaze on the substrate is held in a predetermined face-to-face relationship with the cathode 112. If necessary, the glaze may be adapted to be rotatable or otherwise movable relative to the cathode 112 and a suitable design can be selected appropriately depending on several factors including the substrate size. In addition, a heater may be provided on the upper surface of the substrate holder 108 to perform sputtering with heating.

The distance between the substrate and the target 114 is not limited to any particular value and a distance that provides a uniform thickness profile may be set appropriately within the range from about 20 mm to about 200 mm.

When fabricating the thermal head 66 used in the invention, the surface of the lower protective layer 88 is preferably etched with a plasma prior to the formation of the carbon protective layer 90 in order to improve the adhesion between the carbon protective layer 90 and the lower protective layer 88.

To do this, in the illustrated sputtering apparatus 100, a bias source 122 for applying the radio-frequency voltage is connected to the substrate holder 108. The bias source 122 is used to apply the radio-frequency voltage to the substrate via the matching box and may be selected as appropriate from those in commercial use which produce outputs at 13.56 MHz having powers in the range from about 1 kW to about 5 kW.

The intensity of etching may be determined with the bias voltage to the substrate being used as a guide; usually, an optimal value may be selected from the range of −100 to −500 V.

Figure 4:
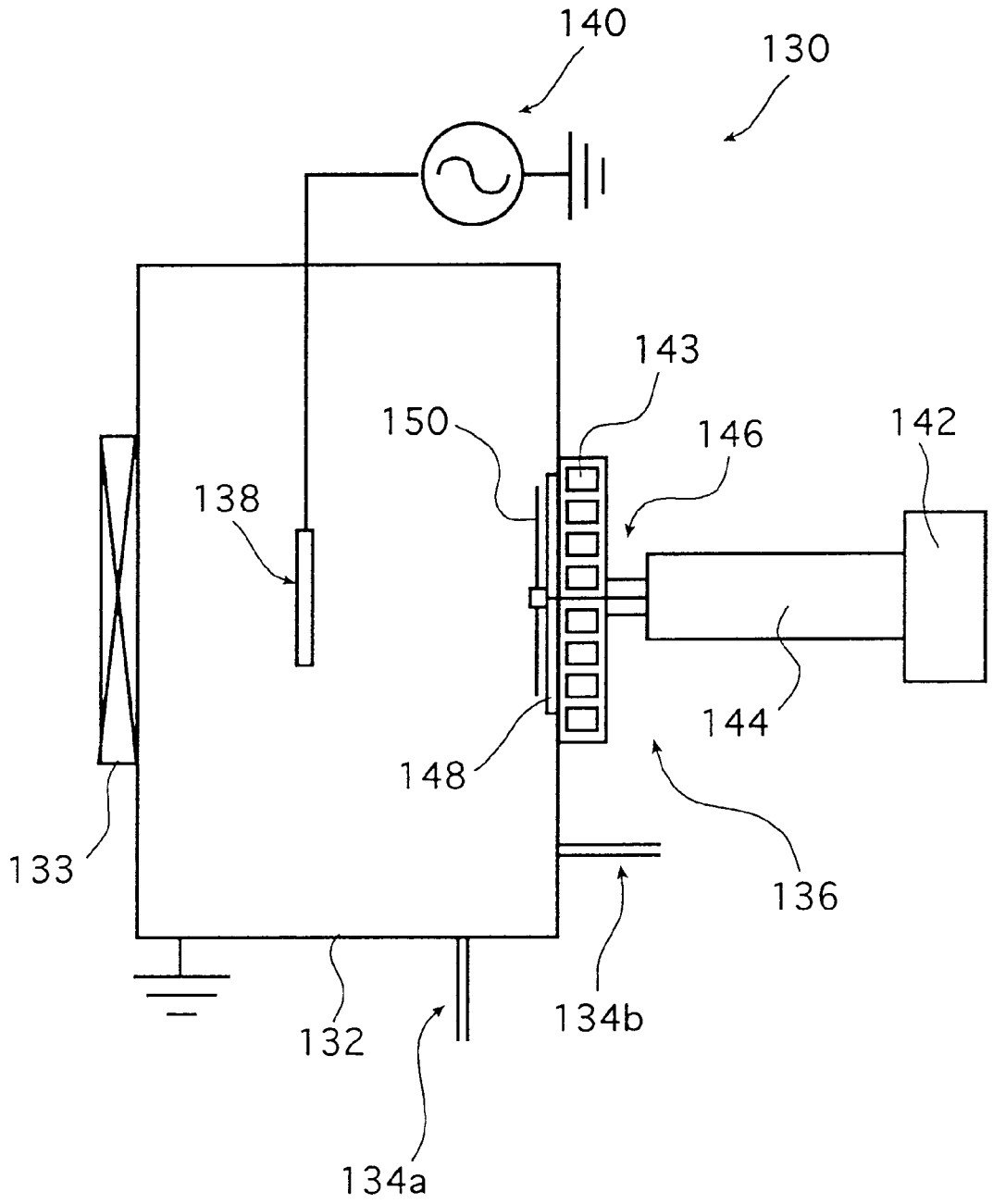
FIG. 4 shows the concept of an exemplary plasma-assisted CVD apparatus for forming a carbon protective layer on the thermal head of the invention.
Figure 5:
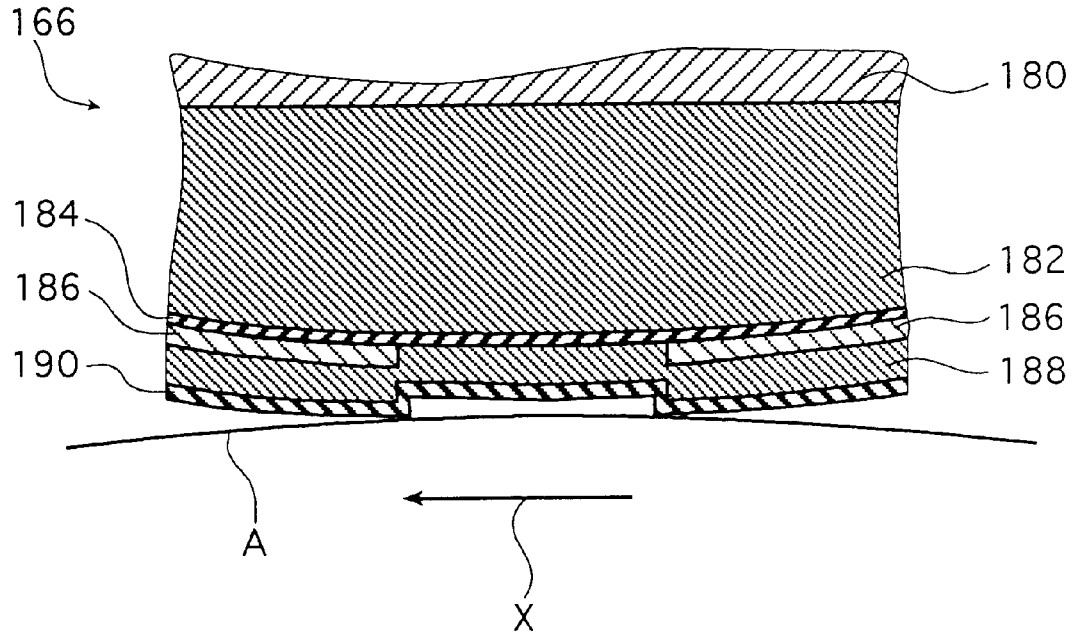
FIG. 5 is a schematic cross sectional view showing the structure of a heating element in a prior art thermal head.

FIG. 4 shows the concept of a plasma-assisted CVD apparatus to form the carbon protective layer 90. The CVD apparatus generally indicated by 130 comprises a vacuum chamber 132, a gas introducing section 134, plasma generating means 136, a substrate holder 138 and a substrate bias source 140 as the basic components.

The vacuum chamber 132 is preferably formed of a nonmagnetic material such as SUS 304 in order to keep unperturbed the magnetic field generated for plasma generation.

Preferably, the vacuum chamber 132 which is used to form the carbon protective layer 90 presents such a vacuum seal property that an ultimate pressure of $2\times10^{-5}$ Torr or below, preferably $5\times10^{-6}$ Torr or below, is reached by initial pump-down whereas an ultimate pressure between $1\times10^{-4}$ Torr and $1\times10^{-2}$ Torr is reached during film deposition.

Vacuum pump-down means 133 is provided for the vacuum chamber 132 and a preferred example is the combination of a rotary pump, a mechanical booster pump and a turbomolecular pump; pump-down means using a diffusion pump or a cryogenic pump may be suitably used instead of the turbomolecular pump. The performance and number of vacuum pump-down means 133 may be determined as appropriate for various factors including the capacity of the vacuum chamber 132 and the flow rate of a gas used during film deposition. In order to increase the pumping speed, various adjustment designs may be employed, such as bypass pipes that provide for evacuation resistance adjustment and orifice valves which are adjustable in the degree of opening.

Those sites of the vacuum chamber 132 where plasma develops or an arc is produced by plasma generating electromagnetic waves may be covered with an insulating member, which may be made of insulating materials including MC nylon, Teflon (PTFE), polyphenylene sulfide (PPS), polyethylene naphthalate (PEN) and polyethylene terephthalate (PET). If PEN or PET is used, care must be taken to insure that the degree of vacuum will not decrease upon degassing of such insulating materials.

The gas introducing section 134 consisting of two parts 134*a* and 134*b*, the former being a site for introducing a plasma generating gas and the latter for introducing a reactive gas, into the vacuum chamber 132 through stainless steel pipes or the like that are vacuum sealed with O-rings or the like at the inlet. The amounts of the gases being introduced are controlled by known means such as a mass flow controller.

Both gas introducing parts 134*a* and 134*b* are basically so adapted as to displace the introduced gases to the neighborhood of the plasma-generating region in the vacuum chamber 132. The blowout position, particularly that of the reactive gas introducing part 134*b*, has a certain effect on the thickness profile of the carbon protective layer to be formed and, hence, it is preferably optimized in accordance with various factors such as the geometry of the substrate (the glaze 82 of the thermal head 66).

Examples of the plasma generating gas for producing the carbon protective layer 90 are inert gases such as helium, neon, argon, krypton and xenon, among which argon gas is used with particular advantage because of price and easy availability. Examples of the reactive gas for producing the carbon protective layer 90 are the gases of hydrocarbon compounds such as methane, ethane, propane, ethylene, acetylene and benzene.

It is required with the gas introducing parts 134*a* and 134*b* that the sensors in the mass flow controllers be adjusted in accordance with the gases to be introduced.

In plasma-assisted CVD to form the carbon protective layer 90, the plasma generating means may utilize various discharges such as DC discharge, RF discharge, DC arc discharge and microwave ECR discharge, among which DC arc discharge and microwave ECR discharge have high enough plasma densities to be particularly advantageous for high-speed film deposition.

The illustrated CVD apparatus 130 utilizes microwave ECR discharge and the plasma generating means 136 comprises a microwave source 142, magnets 143, a microwave guide 144, a coaxial transformer 146, a dielectric plate 148 and a radial antenna 150 and the like.

In DC discharge, a plasma is generated by applying a negative DC voltage between the substrate and the electrode. The DC power supply for use in DC discharge has an output of about 1 to 10 kW and a device having the necessary and sufficient output to produce the carbon protective layer 90 may appropriately be selected. For anti-arc and other purposes, a DC power supply pulse-modulated for 2 to 20 kHz is also applicable with advantage.

In RF discharge, a plasma is generated by applying a radio-frequency voltage to the electrodes via the matching box, which performs impedance matching such that the reflected wave of the radio-frequency voltage is no more than 25% of the incident wave. A suitable RF power supply for RF discharge may be selected from those in commercial use which produce outputs at 13.56 MHz having powers in the range from about 1 kW to about 10 kW which are necessary and sufficient to produce the carbon protective layer 90. A pulse-modulated RF power supply is also useful for RF discharge.

In DC arc discharge, a hot cathode is used to generate a plasma. The hot cathode may typically be formed of tungsten or lanthanum boride ($LaB_6$). DC arc discharge using a hollow cathode can also be utilized. A suitable DC power supply for use in DC arc discharge may be selected from those which produce outputs at about 10 to 50 A having powers in the range from about 1 kW to about 10 kW which are necessary and sufficient to produce the carbon protective layer 90.

In microwave ECR discharge, a plasma is generated by the combination of microwaves and an ECR magnetic field and, as already mentioned, the illustrated CVD apparatus 130 utilizes microwave ECR discharge for plasma generation.

The microwave source 142 may appropriately be selected from those in commercial use which produce outputs at 2.45 GHz having powers in the range from about 1 kW to 3 kW which are necessary and sufficient to produce the carbon protective layer 90.

To generate an ECR magnetic field, permanent magnets or electromagnets which are capable of forming the desired magnetic field may appropriately be employed and, in the illustrated case, Sm—Co magnets are used as the magnets 143. Consider, for example, the case of using microwaves at 2.45 GHz; since the ECR magnetic field has a strength of 875 G (gauss), the magnets 143 may be those which produce a magnetic field with intensities of 500 to 2,000 G in the plasma generating region.

Microwaves are introduced into the vacuum chamber 132 using the microwave guide 144, the coaxial transformer 146, the dielectric plate 148, etc. It should be noted that the state of magnetic field formation and the microwave introducing path, both affecting the thickness profile of the carbon protective layer 90 to be deposited, are preferably optimized to provide a uniform thickness for the carbon protective layer 90.

The substrate holder 138 fixes the thermal head 66 in such a way that the glaze on the substrate is held in a face-to-face relationship with the radial antenna 150. If necessary, the glaze may be adapted to be rotatable or otherwise movable relative to the plasma generating means 136. The substrate holder 138 may be appropriately selected depending on the size of the substrate or the like. In addition, a heater may be provided on the upper surface of the substrate holder 138 to perform film deposition with heating.

The distance between the substrate and the radial antenna 150 is not limited to any particular value and a distance that provides a uniform thickness profile may be set appropriately within the range from about 20 mm to about 200 mm.

In order to form a hard protective film by plasma-assisted CVD, film deposition has to be performed with a negative bias voltage being applied to the substrate. The substrate bias source 140 is used to supply the required bias voltage.

The radio-frequency self-bias voltage is preferably used in the bias source 140. The self-bias voltage is in the range of −100 to −500 V. A suitable RF power supply may be selected from those in commercial use which produce outputs at 13.56 MHz having powers in the range from about 1 kW to about 5 kW. A DC power supply pulse-modulated for 2 to 20 kHz is also applicable with advantage.

When using the carbon protective layer 90 as the upper protective layer, the surface of the lower protective layer 88 is preferably etched with a plasma prior to the formation of the carbon protective layer 90 in order to improve the adhesion between the carbon protective layer 90 and the lower protective layer 88.

The etching method comprises applying the radio-frequency voltage to the substrate via the matching box, as in the sputtering apparatus 100. A suitable RF power supply may be selected from those in commercial use which produce outputs at 13.56 MHz having powers in the range from about 1 kW to about 5 kW. The intensity of etching may be determined with the bias voltage to the substrate being used as a guide; usually, an optimal value may be selected from the range of −100 to −500 V.

On the foregoing pages, the thermal head and the method of manufacturing the thermal head according to the invention have been described in detail but the present invention is in no way limited to the stated embodiments and various improvements and modifications can of course be made without departing from the spirit and scope of the invention.

As described above in detail, the present invention provides a thermal head having a protective film which has significantly reduced corrosion and wear, which is advantageously protected from cracks and peeling-off due to heat and mechanical impact and which allows the thermal head to have a sufficient durability to exhibit high reliability over an extended period of time, thereby ensuring that the thermal recording of high-quality images is consistently performed over an extended period of operation.

Especially, when recording under high-energy and high-pressure conditions on thermal films using a highly rigid substrate such as a polyester film or the like as in the aforementioned medical use, the thermal head also has a sufficient durability to exhibit high reliability over an extended period of time.

The invention will be further illustrated by means of the following specific examples.

EXAMPLE 1

Pretreatment of Silicon Nitride Film:

In order to fabricate a thermal head according to the first aspect of the invention, the method of the invention was used to subject the surface of the glaze of a commercial thermal head (Model KGT-260-12MPH8 of KYOCERA CORP.) to the pretreatment as described below, followed by forming of the upper protective layer.

The thermal head used as the base has a silicon nitride ($Si_3N_4$) film formed in a thickness of 11 $\mu$m as a protective layer on the surface of the glaze and having a Ra value of 3 nm. Therefore, in Example 1, the silicon nitride film served as the lower protective layer 88 which was subjected to the following pretreatment, before the carbon protective layer 90 used as the upper protective layer was formed thereon.

The surface of the lower protective layer 88 (silicon nitride film) in the thermal head was roughened by sand-blasting treatment until the Ra value reached 0.01 $\mu$m. Specifically, glass bead, steal grit or alundum used as abrasives was blown against the lower protective layer 88 in the thermal head by means of an induction-type blasting machine. The air pressure was set to 5 to 7 kg/cm The surface geometry of the lower protective layer 88 was two-dimensionally measured in a plurality of points without cut-off by means of a feeler-type roughness measuring apparatus (P-1 from KLA-TENCOR LTD.) to obtain the Ra values referring to the surface roughness and the average of the Ra values in these points was calculated.

Formation of Carbon Protective Layer:

The sputtering apparatus 100 shown in FIG. 3 was used to form the carbon protective layer 90 on the surface of the glaze in the thermal head having the thus pretreated lower protective layer, to thereby fabricate the thermal head 66 having the glaze 82 shown in FIG. 2 according to the first aspect of the invention.

The sputtering apparatus 100 is further described below.

a. Vacuum Chamber 102

This vacuum chamber was made of SUS 304 and had a capacity of 0.5 $m^3$; vacuum pump-down means 110 comprised one unit each of a rotary pump having a pumping speed of 1,500 L/min, a mechanical booster pump having a pumping speed of 12,000 L/min and a turbomolecular pump having a pumping speed of 3,000 L/sec. An orifice valve was fitted at the suction inlet of the turbomolecular pump to allow for 10 to 100% adjustment of the degree of opening.

b. Gas Introducing Section 104

This gas introducing section was composed of a mass flow controller permitting a maximum flow rate of 100 to 500 sccm and a stainless steel pipe having a diameter of 6 mm. The joint between the stainless steel pipe and the vacuum chamber 102 was vacuum sealed with an O-ring.

Argon gas was used as a plasma generating gas when forming the carbon protective layer 90 as described below.

c. Sputter Means 106

The cathode 112 used was in a rectangular form having a width of 600 mm and a height of 200 mm, with Sm—Co magnets being incorporated as the permanent magnets 112*a*. The backing plate 120 was a rectangular oxygen-free copper member, which was attached to the cathode 112 with In-based solder. The interior of the cathode 112 was water-cooled to cool the magnets, the cathode 112 and the rear side of the backing plate 120.

The power supply 118 was of a DC type at negative potential capable of producing a maximal output of 8 kW. This DC power supply was adapted to be capable of pulse modulation at frequencies in the range of 2 to 10 kHz.

d. Substrate Holder 108

The distance between the substrate (that is, the glaze 82 of the thermal head 66) and the target 114 can be adjusted in the range of from 50 to 150 mm. The distance between the substrate and the target 114 was set to 100 mm when forming the carbon protective layer as described below.

That area of the substrate in which the thermal head was held was set at a floating potential in order to enable the application of an etching radio-frequency voltage.

e. Bias Source 122

An RF power supply was connected to the substrate holder 108 via the matching box.

The RF power supply had a frequency of 13.56 MHz and could produce a maximal output of 3 kW. It was also adapted to be such that by monitoring the self-bias voltage, the RF output could be adjusted over the range of −100 to −500 V.

In the sputtering apparatus 100, thermal head 66 was secured to the substrate holder 108 in the vacuum chamber 102 such that the glaze 82 of the thermal head 66 pretreated as described above would be in a face-to-face relationship with the target 114. All areas of the thermal head other than those where the upper protective layer was to be formed (namely, the non-glaze areas) were previously masked. After the thermal head was fixed in position, the vacuum chamber 102 was pumped down to an internal pressure of $5\times10^{-6}$ Torr.

With continued pump-down, argon gas was introduced through the gas introducing section 104 and the pressure in the vacuum chamber 102 was adjusted to $5.0\times10^{-3}$ Torr by means of the orifice valve fitted on the turbomolecular pump. Subsequently, a radio-frequency voltage was applied to the substrate and the lower protective layer 88 (silicon nitride film) was etched for 10 minutes at a self-bias voltage of −300 V.

After the end of etching, a sintered graphite member was fixed as the target 114 on the backing plate 120 (i.e., attached by means of In-based solder) and a DC power of 0.5 kW was applied to the target 114 for 5 minutes with the shutter 116 being closed and the argon gas flow rate and the orifice valve so adjusted as to maintain the internal pressure in the vacuum chamber 112 at $5.0\times10^{-3}$ Torr.

Subsequently, with the internal pressure in the vacuum chamber 102 kept at the stated level, the DC power was raised to 5 kW and the shutter 116 was opened. The sputtering was performed until the carbon protective layer 90 to be formed has a thickness of lam to thereby fabricate a thermal head having the carbon protective layer 90 deposited in a thickness of 1 $\mu$m as the upper protective layer. The same procedure was repeated to fabricate two additional samples of thermal head having the carbon protective layers deposited in thickness of 2 $\mu$m and 3 $\mu$m.

To control the thickness of the carbon protective layer 90being formed, the deposition rate was determined previously and the time required to reach a specified film thickness was calculated.

Evaluation of Performance:

Using the thus fabricated three samples of thermal head according to the present invention and 5000 sheets of thermal material of B4 size (dry image recording film CR-AT of Fuji Photo Film Co., Ltd.), thermal recording test was performed using the thermal recording apparatus shown in FIG. 1.

The results showed that in every sample of thermal head having the carbon protective layer 90 deposited thereon in thickness of 1 $\mu$m, 2 $\mu$m or 3 $\mu$m, the carbon protective layer 90 had no cracks or peeling-off and wear was little confirmed, and that the thermal head had a sufficiently excellent durability to record high quality images without density unevenness in a consistent manner.

EXAMPLE 2

The procedure of Example 1 was repeated to fabricate additional samples of thermal head except that instead of sandblasting treatment on the lower protective layer (silicon nitride film) of the thermal head in Example 1, lapping sheets of #1000 were passed under the lower protective layer 88 of the thermal head while being in contact therewith to thereby roughen the surface of the lower protective layer until the Ra value reached 0.2 $\mu$m, after which the carbon protective layer 90 was formed by sputtering. Subsequently, performance was evaluated.

The thus obtained samples of thermal head also showed excellent results as in Example 1.

EXAMPLE 3

The procedure of Example 2 was repeated to fabricate additional samples of thermal head except that lapping sheets of #4000 were used in Example 2 to roughen the surface of the lower protective layer until the Ra value reached 0.1 $\mu$m. Subsequently, performance was evaluated.

The thus obtained samples of thermal head also showed excellent results as in Example 1.

EXAMPLE 4

The procedure of Example 2 was repeated to fabricate additional samples of thermal head except that lapping sheets of #8000 were used in Example 2 to roughen the surface of the lower protective layer until the Ra value reached 0.005$\mu$m. Subsequently, performance was evaluated.

The thus obtained samples of thermal head also showed excellent results as in Example 1.

COMPARATIVE EXAMPLE 1

The procedure of Example 1 was repeated to fabricate additional samples of thermal head except that the surface of the glaze (the surface of the silicon nitride film) was not subjected to any pretreatment (i.e. the Ra value of the silicon nitride film was not changed and remained 3 nm). Subsequently, performance was evaluated.

The results showed the carbon protective layer 90 had cracks and peeling-off before recording 5000 sheets.

EXAMPLE 5

The plasma-assisted CVD apparatus 130 shown in FIG. 4 was set up.

Pretreatment of Silicon Nitride Film:

The surface of the glaze of the thermal head (surface of the silicon nitride film) was pretreated as in Example 1.

Formation of Carbon Protective Layer:

The plasma-assisted CVD apparatus 130 used is now described in detail.

a. Vacuum Chamber 132

The same chamber as in Example 1 was used.

b. Gas Introducing Section 134

The gas introducing section having the same structure as in Example 1 was used except that two gas introducing parts for introducing a plasma generating gas and a reactive gas were provided.

Argon gas was used as a plasma generating gas when forming the carbon protective layer 90 as described below.

c. Plasma Generating Means 136

The microwave source 142 oscillating at a frequency of 2.45 GHz and producing a maximal output of 1.5 kW was employed. The generated microwave was guided to the neighborhood of the vacuum chamber 132 by means of the microwave guide 144, converted in the coaxial transformer 146 and directed to the radial antenna 150 in the vacuum chamber 132.

The plasma generating part used was in a rectangular form having a width of 600 mm and a height of 200 mm.

A magnetic field for ECR was produced by arranging a plurality of Sm—Co magnets in a pattern to conform to the shape of the dielectric plate 148.

d. Substrate Holder 138

The same substrate holder as in Example 1 was used, but the distance between the substrate and the radial antenna 150 was set to 150 mm when forming the carbon protective layer 90.

e. Substrate Bias Source 140

An RF power supply was connected to the substrate holder 138 via the matching box.

The RF power supply had a frequency of 13.56 MHz and could produce a maximal output of 3 kW. It was also adapted to be such that by monitoring the self-bias voltage, the RF output could be adjusted over the range of −100 to −500 V.

In the CVD apparatus 130, the substrate bias source 140 also serves as the substrate etching means.

Using the CVD apparatus 130 thus set up, the carbon protective layer 90 constituting the upper protective layer was formed on the surface of the glaze used in Example 1 as described below, to thereby fabricate additional samples of thermal head.

Therefore, the carbon protective layer 90 used as the upper protective layer is formed on the silicon nitride film used as the lower protective layer, as in Example 1.

Thermal head 66 was secured to the substrate holder 138 in the vacuum chamber 132 such that the glaze 82 would be in a face-to-face relationship with the radial antenna 150. All areas of the thermal head other than those where the upper protective layer was to be formed (namely, the non-glaze areas) were previously masked. After the thermal head was fixed in position, the vacuum chamber 132 was pumped down to an internal pressure of $5\times10^{-6}$ Torr.

With continued pump-down, methane gas was introduced through the gas introducing section 104*a* and the pressure in the vacuum chamber 132 was adjusted to $5.0\times10^{-3}$ Torr by means of the orifice valve fitted on the turbomolecular pump. Subsequently, the microwave source 142 was driven to introduce each microwave into the vacuum chamber 132 where a microwave ECR plasma was generated. A radio-frequency voltage was applied to the substrate and the lower protective layer 88 (silicon nitride film) was etched for 10 minutes at a self-bias voltage of −300 V.

After the end of etching, the plasma-assisted CVD was performed by introducing methane gas to adjust the internal pressure in the vacuum chamber 132 at $5.0\times10^{-3}$ Torr, with the radio-frequency voltage being kept applied by the self-bias voltage of −300 V. Thus, the thermal head 66 having the carbon protective layer 90 formed as the upper protective layer in a thickness of 1 μm was fabricated. The same procedure was repeated to fabricate two additional samples of thermal head having the carbon protective layers 90 formed in thickness of 2 μm and 3 μm.

To control the thickness of the carbon protective layer 90 being formed, the deposition rate was determined previously and the time required to reach a specified film thickness was calculated.

Evaluation of Performance:

Using the thus fabricated three samples of thermal head and a thermal material, performance was evaluated as in Example 1 by the thermal recording apparatus shown in FIG. 1.

The results showed that in every sample of thermal head, the carbon protective layer 90 had no cracks or peeling-off and wear was little confirmed.

EXAMPLE 6

The procedure of Example 1 was repeated to fabricate additional samples of thermal head except that instead of sandblasting treatment on the lower protective layer (silicon nitride film) of the thermal head in Example 5, lapping sheets of #1000 were passed under the lower protective layer 88 of the thermal head while being in contact therewith to thereby roughen the surface of the lower protective layer until the Ra value reached 0.2 μm, after which the carbon protective layer 90 was formed by plasma-assisted CVD. Subsequently, performance was evaluated.

The thus obtained samples of thermal head also showed excellent results as in Example 5.

EXAMPLE 7

The procedure of Example 4 was repeated to fabricate additional samples of thermal head except that lapping sheets of #4000 were used in Example 6 to roughen the surface of the lower protective layer until the Ra value reached 0.01 μm. Subsequently, performance was evaluated.

The thus obtained samples of thermal head also showed excellent results as in Example 6.

EXAMPLE 8

The procedure of Example 4 was repeated to fabricate additional samples of thermal head except that lapping sheets of #8000 were used in Example 6 to roughen the surface of the lower protective layer until the Ra value reached 0.005 μm. Subsequently, performance was evaluated.

The thus obtained samples of thermal head also showed excellent results as in Example 4.

COMPARATIVE EXAMPLE 2

The procedure of Example 4 was repeated to fabricate additional samples of thermal head except that the surface of the glaze (the surface of the silicon nitride film) was not subjected to any pretreatment (i.e. the Ra value of the silicon nitride film was not changed and remained 3 nm). Subsequently, performance was evaluated.

The results showed the carbon protective layer 90 had cracks and peeling-off before recording 5000 sheets.

These results clearly demonstrate the effectiveness of the thermal head in the first aspect of the present invention and of the method of the invention.

EXAMPLE 9

Pretreatment of Silicon Nitride Film:

In order to fabricate a thermal head according to the second aspect of the invention, the surface of the glaze (surface of the silicon nitride film) of the commercial thermal head (Model KGT-260-12MPH8 of KYOCERA CORP.) was subjected to the pretreatment as described below, prior to the formation of the carbon protective layer.

The thermal head used as the base has a silicon nitride ($Si_3N_4$) film formed in a thickness of 11 μm as a protective layer on the surface of the glaze and having a depression step due to the thickness of the electrodes of which the depth is 1 μm. Therefore, in Example 9, the silicon nitride film served as the lower protective layer 88 which was subjected to the following pretreatment, before the carbon protective layer 90 used as the upper protective layer was formed thereon.

The surface of the lower protective layer 88 (silicon nitride film) in the thermal head was ground with alumina lapping sheets of #4000 to #16000 until the depth of the depression step due to the electrodes and the heat-generating resistor was substantially reduced to zero. Specifically, 10 alumina lapping sheets of B4 size were passed under the thermal head used as the base, with the thermal head having the lower protective layer 88 being mounted on the printer.

Sputtering was performed on the surface of the lower protective layer 88 of which the depression step was thus removed, followed by forming of the carbon protective layer 90.

Formation of Carbon Protective Layer:

The sputtering apparatus 100 shown in FIG. 3 was used to form the carbon protective layer 90 on the surface of the lower protective layer 88 which was flattened by the pretreatment as described above to thereby fabricate the thermal head 66 having the glaze 82 shown in FIG. 2 according to the second aspect of the invention.

The sputtering apparatus 100 used has the same structure as in Example 1, except that a heater was provided on the surface of the substrate holder 108 for film deposition with heating.

In this Example, three samples of thermal head having the carbon protective layers 90 constituting the upper protective layer and deposited in thickness of 1 μm, 2 μm and 3 μm were fabricated as in Example 1.

Evaluation of Performance:

Using the thus fabricated three samples of thermal head according to the present invention and 5000 sheets of thermal material of B4 size (dry image recording film CR-AT of Fuji Photo Film Co., Ltd.), thermal recording test was performed as in Example 1 using the thermal recording apparatus shown in FIG. 1.

The results showed that in every sample of thermal head having the carbon protective layer 90 deposited thereon in thickness of 1 μm, 2 μm or 3 μm, the carbon protective layer 90 had no cracks or peeling-off and wear was little confirmed as in Example 1, and that the thermal head had a sufficiently excellent durability to record high quality images without density unevenness in a consistent manner.

EXAMPLE 10

The procedure of Example 9 was repeated to fabricate additional samples of thermal head except that the carbon protective layer 90 was formed on the surface of the lower protective layer 88 made of a ceramic, while heating the whole of the substrate of the thermal head at 200 to 450° C. Subsequently, performance was evaluated.

Specifically, a heater was provided on the upper surface of the substrate holder 108 and the substrate was put on the heater, whereby the carbon protective layer 90 was formed while heating the whole of the substrate through the surface of the lower protective layer 88.

The thus obtained samples of thermal head also showed excellent results as in Example 9.

EXAMPLE 11

The procedure of Example 9 was repeated to fabricate additional samples of thermal head except that the carbon protective layer 90 was formed on the surface of the lower protective layer 88, while heating the surface of the lower protective layer 88 made of a ceramic at 200 to 450° C. by energizing the thermal head. Subsequently, performance was evaluated.

Specifically, a constant DC was applied to the common side, with the strobe of the driver IC in the thermal head being ON, to energize the thermal head 66 for heat generation, followed by heating of the surface of the lower protective layer 88 at a constant temperature to thereby form the carbon protective layer 90.

The thus obtained samples of thermal head also showed excellent results as in Example 9.

COMPARATIVE EXAMPLE 3

The procedure of Example 9 was repeated to fabricate additional samples of thermal head except that any pretreatment was not performed to remove the depression step on the surface of the lower protective layer 88. Subsequently, performance was evaluated.

The results showed the carbon protective layer 90 had cracks and peeling-off before recording 5000 sheets.

EXAMPLE 12

The plasma-assisted CVD apparatus 130 shown in FIG. 4 was set up as in Example 5.

Pretreatment of Silicon Nitride Film:

The surface of the lower protective layer 88 of the thermal head 66 was pretreated as in Example 9.

Formation of Carbon Protective Layer:

The procedure of Example 5 was repeated to prepare additional three samples of thermal head according to the second aspect of the invention by means of the plasma-assisted CVD apparatus 130 having the same structure as in Example 5. The samples obtained had the carbon protective layers 90 deposited in thickness of 1 μm, 2 μm and 3 μm as the upper protective layer.

Evaluation of Performance:

Using the thus fabricated three samples of thermal head and a thermal material, performance was evaluated as in Example 9 by the thermal recording apparatus shown in FIG. 1.

The results showed that in every sample of thermal head, the carbon protective layer 90 had no cracks or peeling-off and wear was little confirmed.

EXAMPLE 13

The procedure of Example 12 was repeated to fabricate additional samples of thermal head except that the carbon protective layer 90 was formed on the surface of the lower protective layer 88 made of a ceramic, while heating the whole of the substrate of the thermal head at 200 to 450° C. Subsequently, performance was evaluated.

Specifically, a heater was provided on the upper surface of the substrate holder 108 and the substrate was put on the heater, whereby the carbon protective layer 90 was formed while heating the whole of the substrate through the surface of the lower protective layer 88.

The thus obtained samples of thermal head also showed excellent results as in Example 12.

EXAMPLE 14

The procedure of Example 12 was repeated to fabricate additional samples of thermal head except that the carbon protective layer 90 was formed on the surface of the lower protective layer 88, while heating the surface of the lower protective layer 88 made of a ceramic at 200 to 450° C. by energizing the thermal head. Subsequently, performance was evaluated.

Specifically, a constant DC was applied to the common side, with the strobe of the driver IC in the thermal head being ON, to energize the thermal head 66 for heat generation, followed by heating of the surface of the lower protective layer 88 at a constant temperature to thereby form the carbon protective layer 90.

The thus obtained samples of thermal head also showed excellent results as in Example 12.

COMPARATIVE EXAMPLE 4

The procedure of Example 12 was repeated to fabricate additional samples of thermal head except that any pretreatment was not performed to remove the depression step on the surface of the lower protective layer 88. Subsequently, performance was evaluated.

The results showed the carbon protective layer 90 had cracks and peeling-off before recording 5000 sheets.

These results clearly demonstrate the effectiveness of the thermal head in the second aspect of the present invention.

What is claimed is:

1. A thermal head having a protective film of a heater formed on said heater, said protective film comprising a ceramic-based lower protective layer composed of at least one sub-layer and a carbon-based upper protective layer formed on said lower protective layer, wherein a surface of said lower protective layer on which said upper protective layer is to be formed has a surface roughness value Ra of 0.005 to 0.5 μm.

2. The thermal head according to claim 1, wherein said carbon-based protective layer is a high-purity carbon protective layer.

3. The thermal head according to claim 1, wherein said carbon-based protective layer has a Vickers hardness of at least 2000 kg/mm$^2$.

4. The thermal head according to claim 1, wherein said carbon-based protective layer has a thickness of from 1 to 20 $\mu$m.

5. The thermal head according to claim 1, wherein said ceramic-based protective layer is a protective layer made of a material selected from the group consisting of silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures of at least two of these materials.

6. The thermal head according to claim 1, wherein said lower protective layer has a thickness of from 0.6 to 50 $\mu$m.

7. The thermal head according to claim 1, wherein said carbon-based protective layer has a thickness of from 0.1 to 5 $\mu$m.

* * * * *